US011725424B2

(12) United States Patent
Lin

(10) Patent No.: US 11,725,424 B2
(45) Date of Patent: Aug. 15, 2023

(54) DOOR LOCK DEVICE AND ELECTRIC CONTROL ASSEMBLY THEREOF

(71) Applicant: THASE ENTERPRISE CO., LTD., New Taipei (TW)

(72) Inventor: Ching-Tien Lin, New Taipei (TW)

(73) Assignee: THASE ENTERPRISE CO., LTD., New Taipei (TW)

( * ) Notice: Subject to any disclaimer, the term of this patent is extended or adjusted under 35 U.S.C. 154(b) by 266 days.

(21) Appl. No.: 17/095,099

(22) Filed: Nov. 11, 2020

(65) Prior Publication Data

US 2021/0381278 A1 Dec. 9, 2021

(30) Foreign Application Priority Data

Jun. 8, 2020 (TW) ..... 109207140

(51) Int. Cl.
*E05B 65/10* (2006.01)

(52) U.S. Cl.
CPC ..... *E05B 65/1053* (2013.01); *E05B 65/108* (2013.01); *Y10T 292/0822* (2015.04); *Y10T 292/096* (2015.04); *Y10T 292/0908* (2015.04)

(58) Field of Classification Search
CPC ..... E05B 65/1053; E05B 65/108; Y10T 292/0908; Y10T 70/5159; Y10T 292/1021; Y10T 292/0822; Y10T 70/713; Y10T 292/096; Y10T 292/0909; Y10T 292/1031
See application file for complete search history.

(56) References Cited

U.S. PATENT DOCUMENTS 3,767,238 A * 10/1973 Zawadzki ..... E05B 65/1053 292/201
3,801,144 A * 4/1974 Diehl ..... E05B 47/0002 70/92
3,873,141 A * 3/1975 Peterson ..... E05B 65/1066 292/210
4,384,738 A * 5/1983 Floyd ..... E05B 65/1073 292/336.3
5,011,199 A * 4/1991 Lowe ..... E05B 65/1093 292/DIG. 65
5,035,450 A * 7/1991 Muller ..... E05B 47/0046 292/341.16
5,085,475 A * 2/1992 Austin ..... E05B 65/1093 292/144
7,536,885 B1 * 5/2009 Ross ..... E05B 65/1073 70/92
2004/0124639 A1 * 7/2004 Lin ..... E05B 65/1073 292/92
2004/0183311 A1 * 9/2004 Lin ..... E05B 65/104 292/92
2007/0246947 A1 * 10/2007 Banks ..... E05B 57/00 292/93
2008/0012350 A1 * 1/2008 Condo ..... E05B 65/1093 292/92
2008/0106104 A1 * 5/2008 Lin ..... E05B 63/0065 292/92

(Continued)

*Primary Examiner* — Christine M Mills
*Assistant Examiner* — Faria F Ahmad
(74) *Attorney, Agent, or Firm* — Kelly & Kelley, LLP

(57) ABSTRACT

A door lock device for emergency doors is provided, in which, through a configuration of a sensing component, the actuating time can be adjusted by a driver according to demands to facilitate time-delayed unlocking.

8 Claims, 9 Drawing Sheets

(56) References Cited

U.S. PATENT DOCUMENTS

| | | | | |
|---|---|---|---|---|
| 2010/0045053 | A1* | 2/2010 | Dye | E05B 65/1053 292/201 |
| 2011/0047874 | A1* | 3/2011 | Lowder | E05B 65/1053 49/31 |
| 2011/0239712 | A1* | 10/2011 | Tien | E05B 65/1053 70/92 |
| 2012/0032455 | A1* | 2/2012 | Lin | E05B 17/0041 292/92 |
| 2015/0137528 | A1* | 5/2015 | Geringer | E05B 47/0012 292/144 |
| 2017/0292294 | A1* | 10/2017 | Brennan | E05B 63/18 |
| 2018/0245375 | A1* | 8/2018 | Arlinghaus | E05B 81/77 |

* cited by examiner

DOOR LOCK DEVICE AND ELECTRIC CONTROL ASSEMBLY THEREOF

BACKGROUND

1. Technical Field

The present disclosure relates to a door lock device, and more particularly, to a door lock device for an emergency door and an electric control assembly thereof.

2. Description of Related Art

Typically, a conventional emergency door lock, as shown in FIG. 1, includes a crossbar lock 12 provided on an emergency door 11 which allows one directional access, and a push bar 121 provided on the crossbar lock 12. To open the emergency door 11, the push bar 121 can be pressed (in a pressing direction P shown in FIG. 1) to retract a lock bolt 123 in a lock housing 122 of the crossbar lock 12, which allows the crossbar lock 12 to be placed in an unlocked state, and the emergency door 11 can be opened.

Traditional emergency door locks are usually used in public places such as residential buildings, stores, shopping malls, restaurants and the like, where owners or operators are required to have escape routes in place in each floor to satisfy the safety requirements of these venues.

However, since existing emergency doors 11 are produced in view of safety regulations, they cannot be locked. If a place is not guarded by security, unauthorized personnel may enter the place through the emergency door 11, presenting security risks.

Therefore, there is need for improvements for an emergency door that is allowed to be opened at appropriate times or an emergency door that is designed with a controllable opening time.

SUMMARY

In view of the aforementioned shortcomings of the prior art, the present disclosure provides a door lock device, which may include: a lock assembly including a push bar and a lock provided on the push bar; a base provided within the push bar and including a receiving space; a connecting rod provided within the push bar and passing through the receiving space to link with the lock; a sliding piece provided within the receiving space in a displaceable manner; a swinging piece pivotally connected to the base and positioned in the receiving space to link with the sliding piece; a driver for driving the sliding piece to displace; and a sensing component provided on the swinging piece and communicatively connected with the driver for sensing movements of the connecting rod.

In the aforementioned door lock device, the base is fixed to the push bar via a supporting piece.

In the aforementioned door lock device, the base is directly fixed to the push bar.

In the aforementioned door lock device, the connecting rod includes an elevated portion and the sensing component senses a distance between the elevated portion and the sensing component.

In the aforementioned door lock device, the sensing component is communicatively connected with the driver via a circuit component.

The present disclosure further provides an electric control assembly, which may include: a base including a receiving space; a connecting rod passing through the receiving space and including an elevated portion; a sliding piece provided within the receiving space in a displaceable manner; a swinging piece pivotally connected to the base and positioned in the receiving space to link with the sliding piece; a sensing component provided on the swinging piece for sensing a distance between the elevated portion and the sensing component.

In the aforementioned electric control assembly, the base includes a slot formed corresponding to a direction along which the connecting rod passes through the receiving space.

The aforementioned electric control assembly of the present disclosure may further include a driver for driving displacement of the sliding piece. For example, the driver is communicatively connected with the sensing component.

In the aforementioned electric control assembly, the base includes a bar frame to allow ease of handling.

As can be seen from the above, with the design of the sensing component, the door lock device and the electric control assembly thereof in accordance with the present disclosure allow the actuating time to be adjusted by the driver to facilitate delayed unlocking. Thus, compared to the prior art, if the door lock device of the present disclosure is provided on an emergency door and when the push bar of the door lock device in accordance with the present disclosure is pressed for the first time, the lock cannot be unlocked through the connecting rod, but the elevated portion of the connecting rod will actuate the sensing component, such that the sensing component sends out a control signal to the circuit component for time delay. After the delayed period of time, the circuit component then sends out a response signal to the driver, which in turn moves the sliding piece and the swinging piece. Then, if the push bar is pressed for the second time, the lock can be unlocked through the connecting rod, thereby accomplishing delayed unlocking.

BRIEF DESCRIPTION OF THE DRAWINGS

FIG. 2' is a schematic partial perspective view of FIG. 2 in accordance with another embodiment of the present disclosure.

FIG. 2" is a schematic partial perspective view of FIG. 2'.

DETAILED DESCRIPTION

The implementations of present disclosure are illustrated using the following specific embodiments. Other advantages and technical effects of the present disclosure can be readily understood by one of ordinary skill in the art in light of the disclosure of this specification.

Figure 1:
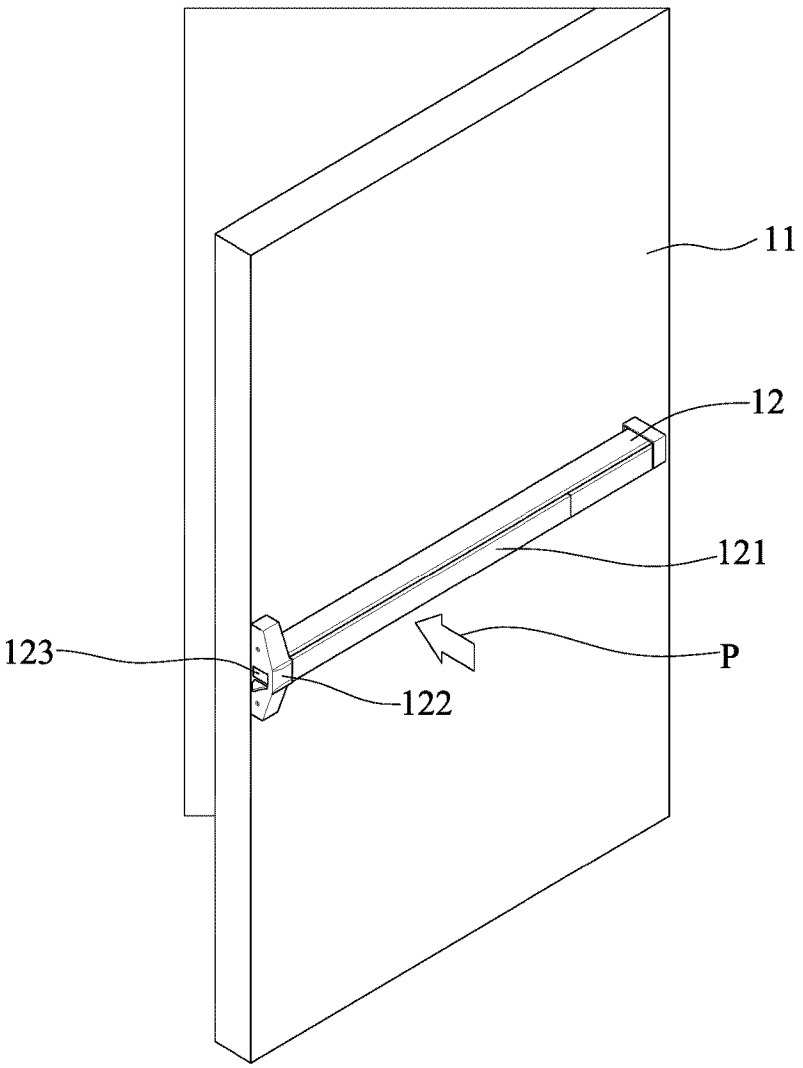
FIG. 1 (PRIOR ART)
FIG. 1 is a schematic perspective view of a conventional emergency door.
Figure 2:
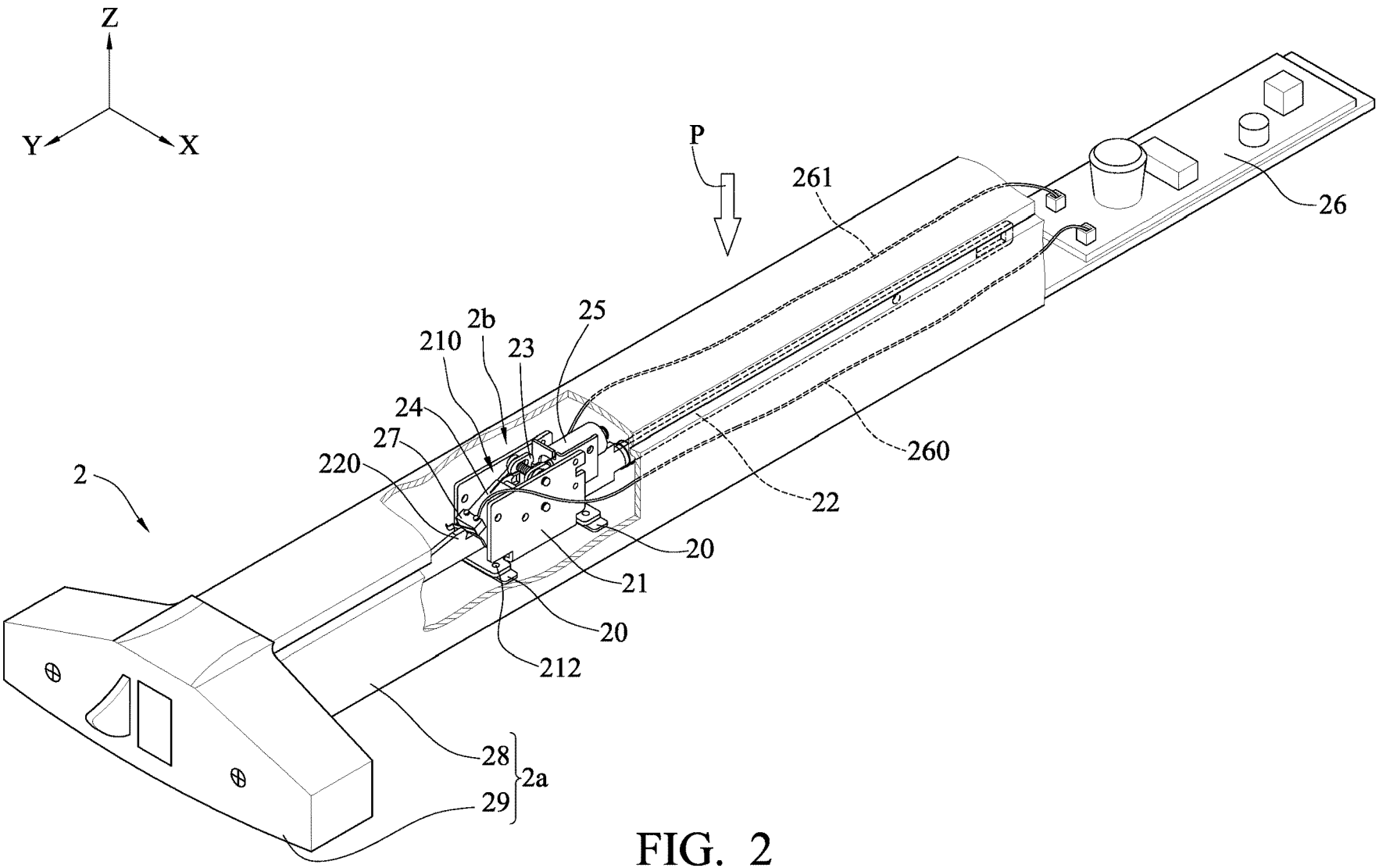
FIG. 2 is a schematic perspective view of a door lock device in accordance with an embodiment of the present disclosure.
Figure 2:
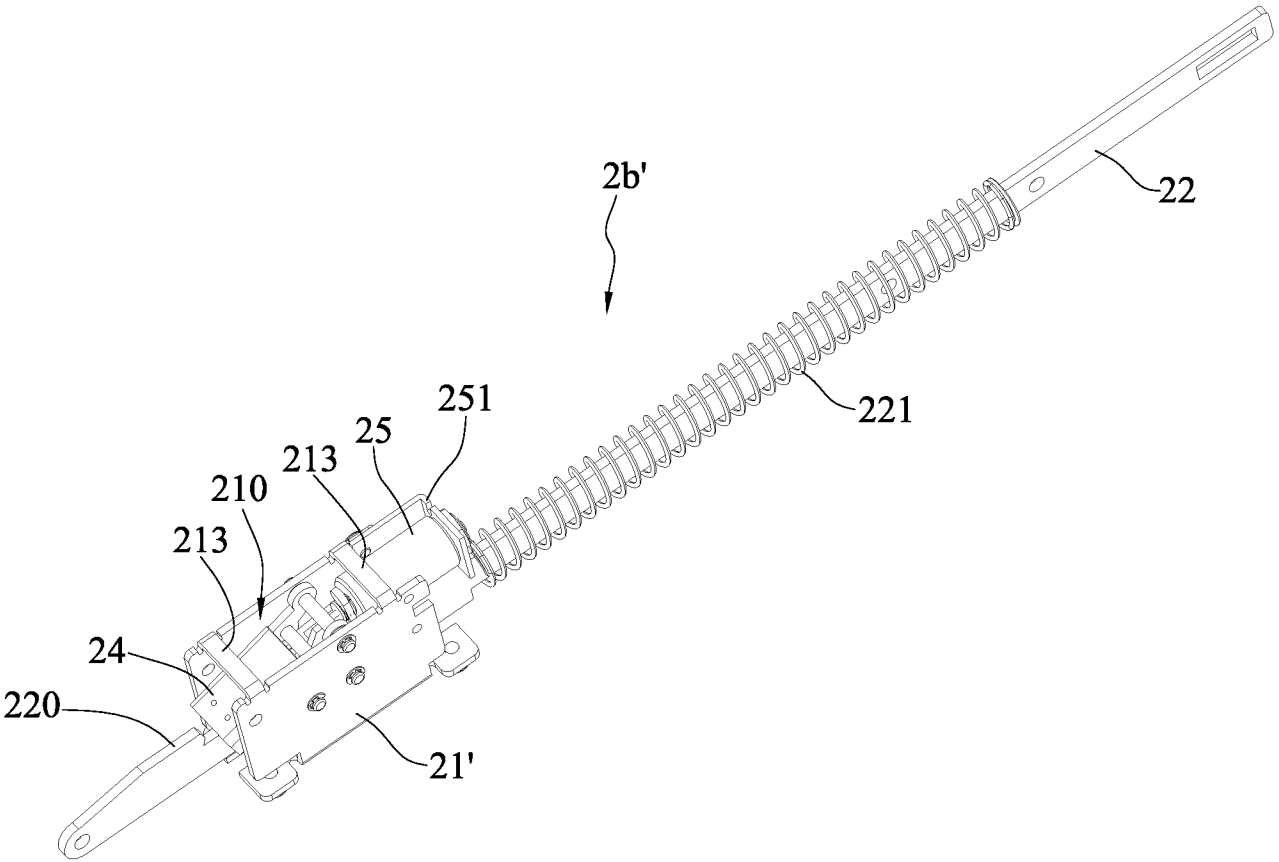
Figure 2:
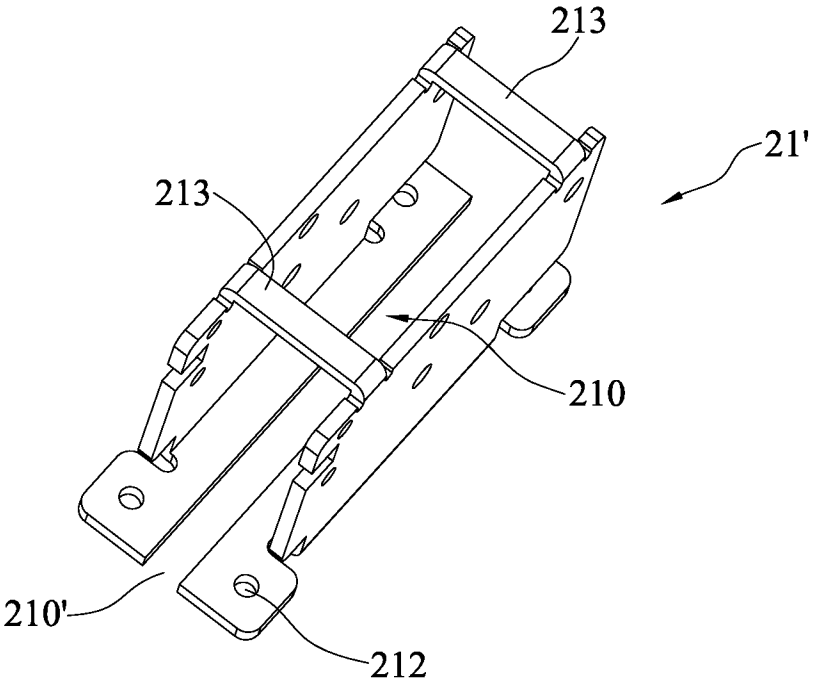
Figure 3:
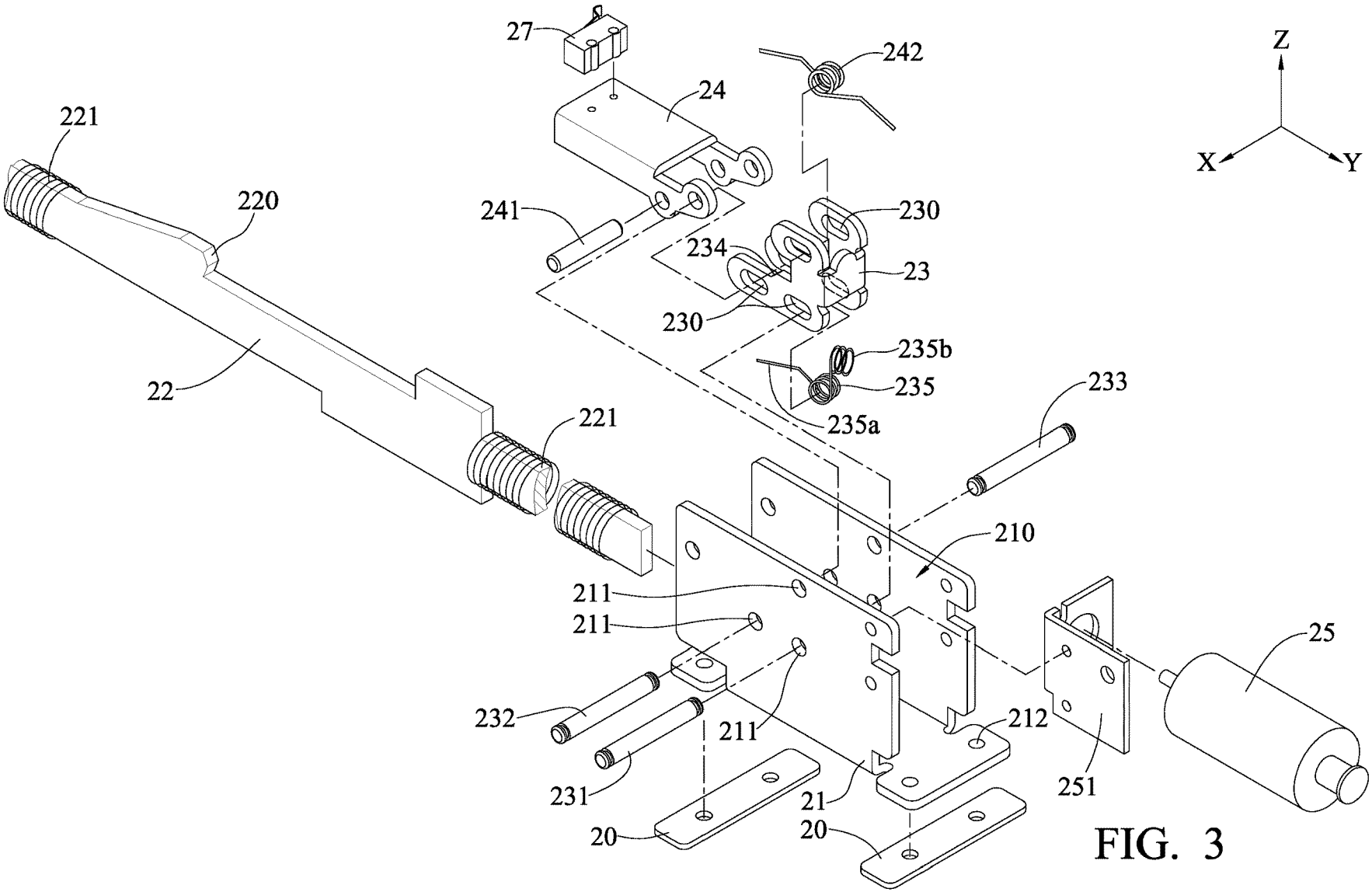
FIG. 3 is a schematic exploded perspective view of FIG. 2.

Referring to FIGS. 2 and 3, a door lock device 2 of the present disclosure is applicable to an emergency door. As shown in FIGS. 2 and 3, the door lock device 2 includes a lock assembly 2*a* and an electric control assembly 2*b* linked to the lock assembly 2*a*.

In an embodiment, the door lock device 2 is provided on a door panel (not shown) of the emergency door through the lock assembly 2*a*. As such, the width direction of the lock assembly 2*a* is defined as the front and back directions (as indicated by arrow direction X); the extension direction of the lock assembly 2*a* is defined as the left and right directions (as indicated by arrow direction Y); and the direction towards which the lock assembly 2*a* is installed is defined as the up and down directions (as indicated by arrow direction Z). It should be appreciated that the orientations of the arrow directions X, Y and Z are arbitrarily defined for illustrating the configuration of this embodiment and the present disclosure is not limited thereto.

The lock assembly 2*a* is a crossbar lock, which includes a push bar 28 fixed onto the door panel and a lock 29 provided at one end of the push bar 28. The lock 29 can be unlocked by the electric control assembly 2*b* actuated by the push bar 28 to allow a user to push open the emergency door.

In an embodiment, there can be numerous specifications for the interior structures of the lock 29 and can be chosen according to needs. A description of the specifications of the interior structures of the lock 29 is thus omitted herein.

The electric control assembly 2*b* includes a base 21, a connecting rod 22, a sliding piece 23, a swinging piece 24, a driver 25, a circuit component 26 and a sensing component 27.

The base 21 is fixed inside the push bar 28 of the lock assembly 2*a* via at least one supporting piece 20.

In an embodiment, the base 21 is shaped in such a way that it forms a receiving space 210 therein. Upper, left and right sides of the receiving space 210 are open. For example, a lower side of the base 21 is provided with at least one retaining hole 212 for securing the supporting piece 20 on the push bar 28.

In another embodiment, as shown in FIGS. 2' and 2", the electric control assembly 2*b'* can also be modularized, wherein the supporting piece 20 is omitted and the circuit component 26 is partitioned off. For example, an open slot 210' corresponding to the connecting rod 22 is formed at the lower side of the base 21'. The retaining hole 212 of the base 21' is directly fixed to the push bar 28. At least one bar frame 213 is provided at the upper side of the base 21' as a handle for allowing the user to pick up and place the base 21'. More specifically, the driver 25 is communicatively connected with the sensing component 27, and the slot 210' is shaped in such a way that corresponds to the direction of the connecting rod 22 passing through the receiving space 210. Therefore, the modular electric control assembly 2*b'* can be regarded as a single independent finished product that can be installed onto or removed from the door lock device 2 by the user.

The connecting rod 22 passes through the receiving space 210 of the base 21, and is mechanically connected, and thus linked, to the lock 29 of the lock assembly 2*a*.

In an embodiment, the connecting rod 22 is provided in parallel to the push bar 28, such that the left and right ends thereof protrude from the base 21. An elevated portion 220 is formed between the left and right ends. For example, the elevated portion 220 is shaped like a hook and is positioned at the left opening of the receiving space 210 in proximity to the left end of the connecting rod 22. Specifically, based on the location of the base 21, the length of the connecting rod 22 protruding from the right end of the base 21 is greater than the length of the connecting rod 22 protruding from the left end of the base 21 as shown in FIG. 2.

Moreover, a first elastic component 221, such as an elastic spring, is provided on the right side of the connecting rod 22 to enable reciprocating (e.g., back and forth) motions of the connecting rod 22. In addition, the first elastic component 221 can also be provided on the left side of the connecting rod 22 (as shown in FIG. 3) or connected to a linking mechanism (not shown) of the lock 29.

The sliding piece 23 is pivotally connected to the base 21 and is positioned above the connecting rod 22 in the receiving space 210.

In an embodiment, the sliding piece 23 is shaped like a sledge or a shoe with a lower side extending out more than an upper side. A plurality of elongated through holes 230 are formed on the lower and upper sides, respectively. A plurality of pins (e.g., a first pin 231, a second pin 232 and a third pin 233) pass through the respective through holes 230 and positioning holes 211 of the base 21, so that the sliding piece 23 is pivotally connected to the base 21. For example, the through holes 230 are provided on the upper and lower sides of the sliding piece 23. More specifically, a pair of through holes 230 are provided on the upper side of the sliding piece 23, and two pairs of through holes 230 are provided on the lower side of the sliding piece 23. The positioning holes 211 are provided on the base 21 at locations corresponding to the through holes 230. As such, the movements of the sliding piece 23 are limited when the sliding piece 23 is slidably provided in the receiving space 210.

In addition, a drive portion 234 (e.g., in the shape of a slope or an inclined ladder) is provided between the upper and lower sides of the sliding piece 23.

Figure 5A:
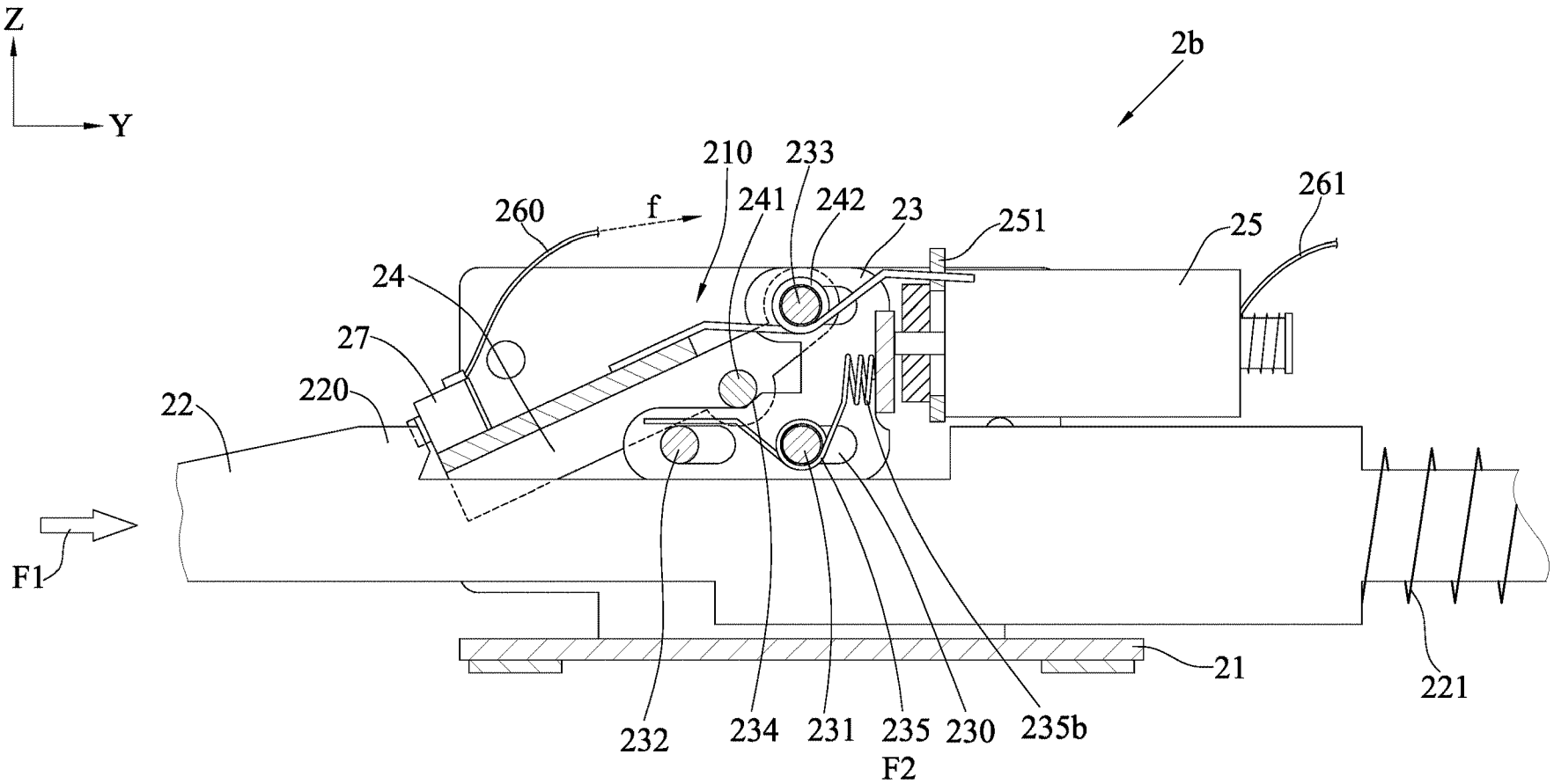
FIGS. 5A to 5C are schematic partial cross-sectional views depicting the door lock device of FIG. 2' when in operations.

Furthermore, the first pin 231 is one of the pins positioned on the lower side of the sliding piece 23. The first pin 231 is sheathed with a second elastic component 235, such as a torsion spring. For example, the second elastic component 235 has a bent shape, such that one end 235*a* (left end) of the torsion spring is fixed to the second pin 232 (which is the other one of the pins positioned on the lower side of the sliding piece 23), while the other end 235*b* (top end) thereof is fixed onto the sliding piece 23 (as shown in FIG. 5A) to allow reciprocating motions of the sliding piece 23.

The swinging piece 24 is pivoted on the third pin 233 (which is positioned on the upper side of the sliding piece 23) in the receiving space 210 of the base 21, so as to create relative sliding motions between the swinging piece 24 and the sliding piece 23.

In an embodiment, the swinging piece 24 is in the shape of an upside down sledge and is provided with a contact portion 241 that abuts against the drive portion 234 on the right side of the swinging piece 24. For example, the contact portion 241 is a bolt, so that the contact portion 241 is pushed by the drive portion 234 while the sliding piece 23 is being displaced (as shown in FIG. 5A), such that the swinging piece 24 is swung slightly upwards or downwards.

Moreover, the third pin 233 is sheathed with a third elastic component 242, for example, a torsion spring. In an example, two ends of the third elastic component 242 are fixed to the swinging piece 24 and the driver 25 (e.g., a fastening seat 251, which will be described later), respectively, such that the swinging piece 24 leans towards the connecting rod 22, that is, the swinging piece 24 is tilted downwards and the connecting rod 22 is covered by the swinging piece 24. For instance, the left side of the swinging piece 24 is limited by the elevated portion 220 of the connecting rod 22, so that the swinging piece 24 does not go over the elevated portion 220.

The driver 25 is a driver having an electromagnetic valve or a linear motor, and is fixed at an opening at the right side of the base 21 via a fastening seat 251.

In an embodiment, the driver 25 moves the sliding piece 23 towards the left or the right (along arrow direction Y), which in turn pushes the swinging piece 24 over the elevated portion 220 of the connecting rod 22, allowing the connecting rod 22 to be displaced to unlock or delay unlocking of the lock 29 of the lock assembly 2*a*.

The circuit component 26 is electrically connected with the driver 25 and the sensing component 27 via a plurality of wires 260, 261.

In an embodiment, the circuit component 26 is a circuit board structure, including circuits such as a processor, a microprocessor or a chip.

The sensing component 27 is disposed on the left side of the swinging piece 24 and is communicatively connected with the driver 25. The sensing component 27 is used for sensing the movements of the connecting rod 22.

Figure 4:
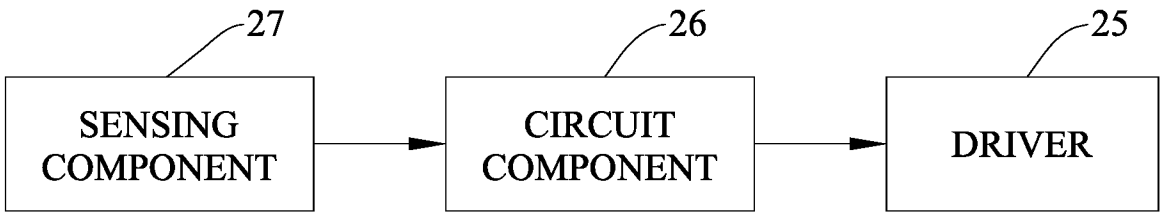
FIG. 4 is a schematic circuit block diagram depicting the door lock device in accordance with an embodiment of the present disclosure.

In an embodiment, the sensing component 27 is a pressure sensor for sensing the distance between the elevated portion 220 and the sensing component 27. When the elevated portion 220 of the connecting rod 22 abuts against the sensing component 27, the sensing component 27 sends a control signal to the circuit component 26. For example, the sensing component 27 is communicatively connected with the driver 25 through the circuit component 26. More specifically, as shown in FIG. 4, once the control signal from the sensing component 27 is received and processed by the circuit component 26, the circuit component 26 then outputs a response signal to the driver 25 for controlling the movements of the driver 25.

Figure 5B:
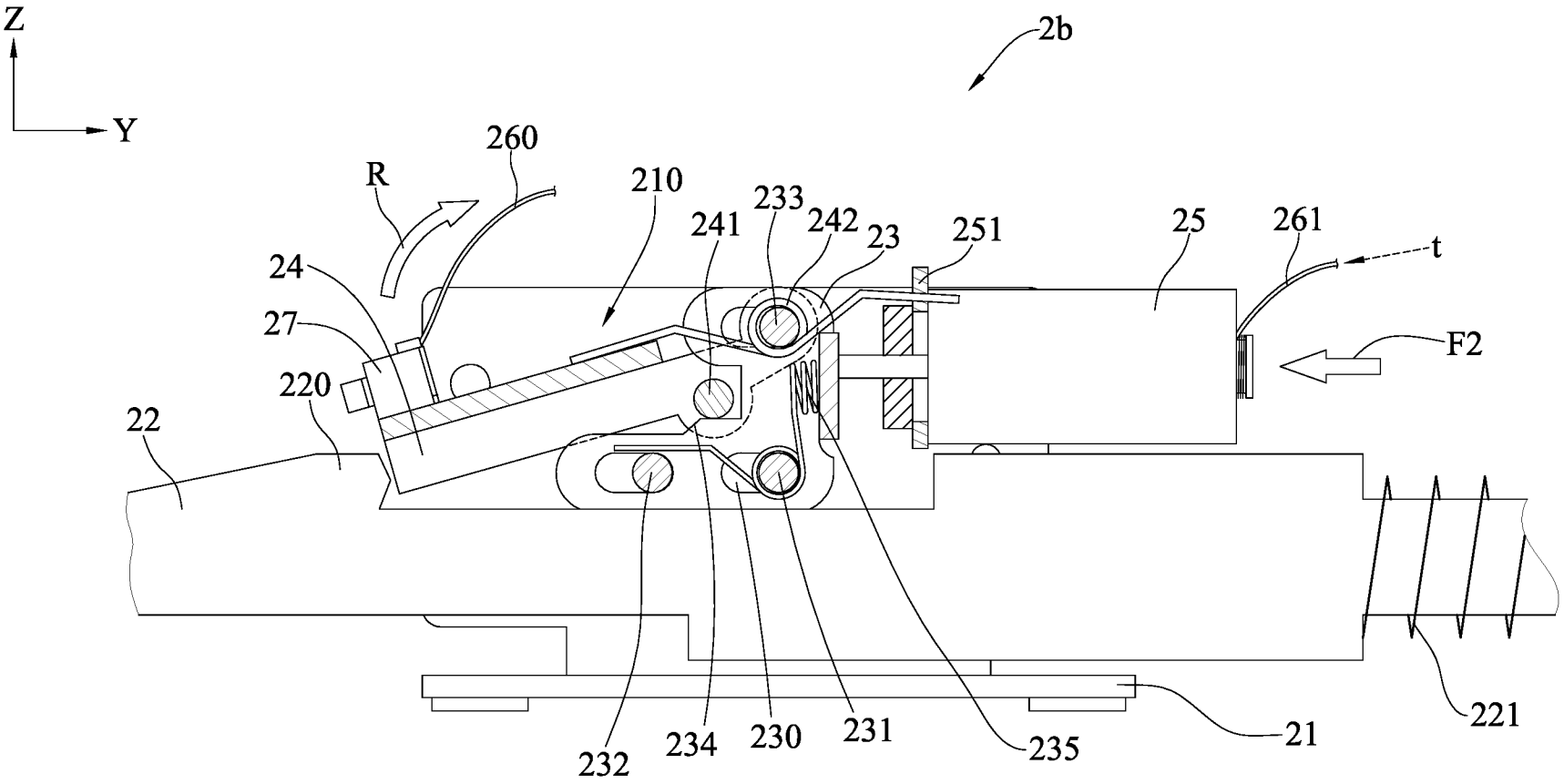
Figure 5C:
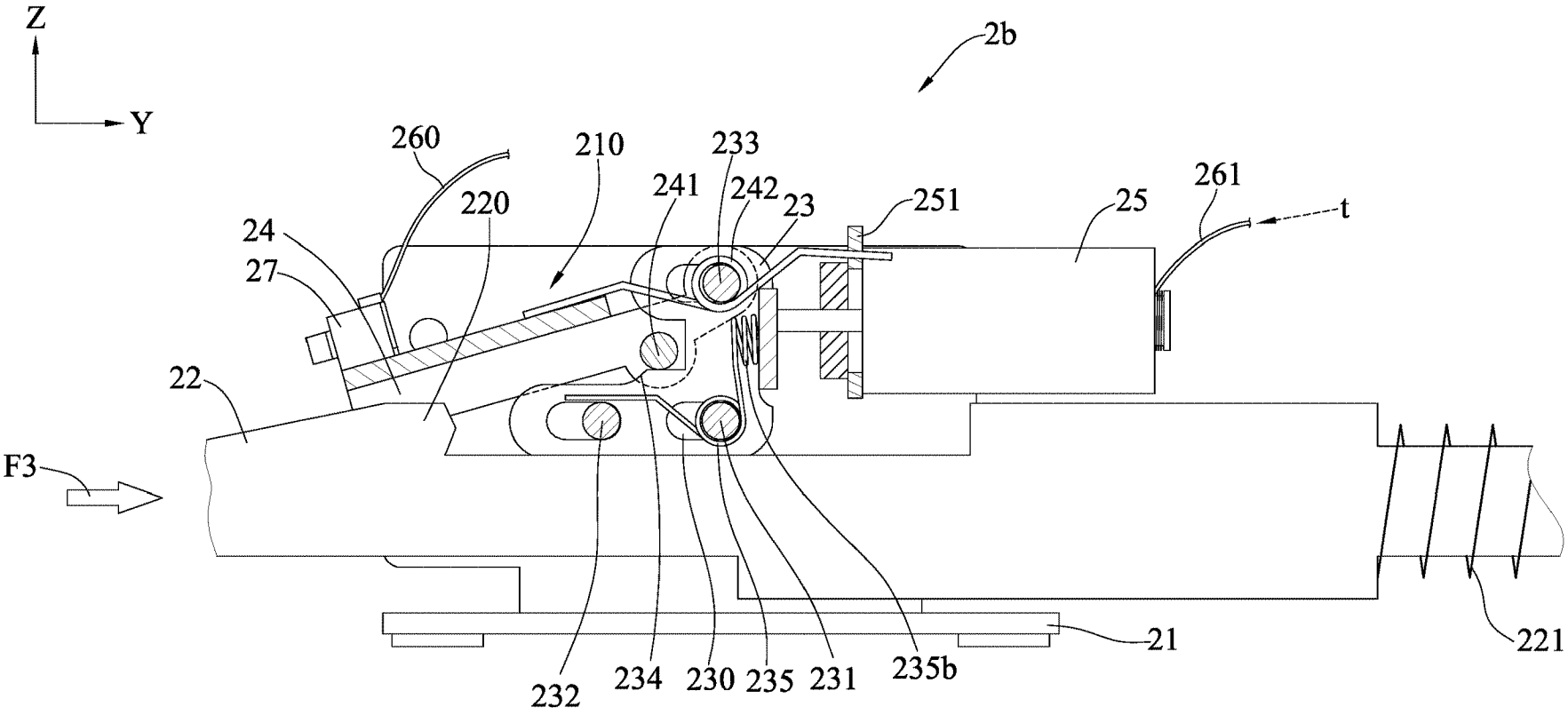

Referring to FIGS. 5A to 5C, the use of the door lock device 2 disposed on the emergency door is specifically described.

As shown in FIG. 5A, when a user presses (in a pressing direction P shown in FIG. 2) the push bar 28 of the lock assembly 2*a* for the first time, the push bar 28 moves the lock 29, which in turn, pushes the left end of the connecting rod 22 towards the base 21 (as indicated by an acting direction F1 shown in FIG. 5A), such that the elevated portion 220 of the connecting rod 22 abuts against and actuates the sensing component 27, which immediately sends a control signal f to the circuit component 26. Meanwhile, the swinging piece 24 has not crossed over the elevated portion 220, so the connecting rod 22 is prevented from moving linearly to the right by the swinging piece 24. As a result, the lock 29 cannot be unlocked and the emergency door cannot be opened.

Furthermore, since the emergency door is still locked, the push bar 28 is released after the push bar 28 is pressed for the first time, and the connecting rod 22 is returned to its original position owing to the reciprocating motions brought by the first elastic component 221.

As shown in FIG. 5B, the circuit component 26 receives and processes the control signal f, and after a target period has elapsed, the circuit component 26 sends a response signal t to the driver 25. The driver 25 then causes the sliding piece 23 to move horizontally towards the left (as indicated by an acting direction F2 shown in FIG. 5B). This pushes the contact portion 241 of the swinging piece 24, and at the same, compresses the end 235*b* of the second elastic component 235, and causes the swinging piece 24 to swing relative to the third pin 233 and the third elastic component 242 to twist.

In an embodiment, the driver 25 is actuated by the response signal t sent by the circuit component 26 after waiting for a target period to elapse. For example, the response signal t is sent by the circuit component 26 after the target period (e.g., five seconds) has passed since the control signal f is received by the circuit component 26. As a result, five seconds after the push bar 28 is pressed for the first time, the driver 25 will then be actuated to move the sliding piece 23, causing the swinging piece 24 to swing upwards (as indicated by an acting direction R shown in FIG. 5B) and cross over the elevated portion 220.

As shown in FIG. 5C, when the swinging piece 24 is unengaged (i.e., when the swinging piece 24 climbs over the elevated portion 220), the user can push down the push bar 28 again (or for the second time). At this time, the connecting rod 22 is allowed to move linearly towards the right (as indicated by an acting direction F3 shown in FIG. 5C). As a result, the pressing of the push bar 28 allows the lock 29 to be unlocked and the emergency door to be successfully opened.

In an embodiment, the first and second presses are complete actions in that after the second press, the lock 29 is returned to the locked state. More specifically, when the circuit component 26 is no longer sending the response signal t, the driver 25 returns to its original state. At this time, the third elastic component 242 releases its torque and the swinging piece 24 is swung back to its original position. In the meantime, the second elastic component 235 also releases its compression force at the end 235*b* to push the sliding piece 23 back to its original position. In other words, the swinging piece 24 and the sliding piece 23 are restored to their original positions (before the driver 25 is driven) by the elastic forces of the third elastic component 242 and the second elastic component 235, respectively.

Thus, with the design of the door lock device 2 of the present disclosure, consumers inside a store, unware of the "delayed" opening of the emergency door, may be deterred from accessing through the emergency door if they find it still locked after attempting to open it. On the other hand, staff members will know that the emergency door can be opened by pressing it and waiting for a period of time (target period) before pressing it again. This ensures the consumers in the store cannot gain access to different levels of the building through the emergency door, while allowing access to staff member.

Moreover, an anti-theft system can be connected externally or built into the circuit component 26 as needed. In the event of a theft incident, the circuit component 26 will receive a control signal f from the anti-theft system. This disables the driver 25 (e.g., the target period is ∞ seconds) and places the emergency door in an always-closed state to prevent the thief from escaping. Alternatively, the circuit component 26 can also be connected externally to or built-in with a fire alarm system, so in the event of a fire, the circuit component 26 will receive a signal from the fire alarm system to cause the driver 25 to actuate immediately (e.g., the target period is zero second), placing the emergency door in an "always-open" state to facilitate a smooth evacuation.

In summary of the above, with the design of the sensing component 27, the door lock device 2 and the electric control assembly 2*b* thereof in accordance with the present disclosure allow the actuating time of the driver 25 to be adjusted to facilitate delayed unlocking. Thus, compared to the prior art, an unauthorized person will not be able to open the emergency door installed with the door lock device 2 after pressing the push bar 28 once. This prevents unauthorized personnel from easily gaining access through the emergency door and causing security vulnerability.

Moreover, based on the design of the electric control assembly 2*b* shown in FIG. 2, when one of the components in the electric control assembly 2*b* needs replacement, the whole door lock device 2 will have to be replaced. On the other hand, based on the modular design of the electric control assembly 2*b'* shown in FIG. 2', only those components surrounding the base 21' need to be replaced if needed without having to remove the circuit component 26. In other words, only the wires 260, 261 need to be disconnected before a component of the electric control assembly 2*b'* is replaced without the need to replace the entire door lock device 2. Thus, with the modular design of the electric control assembly 2*b'*, the present disclosure is capable of reducing the maintenance cost of the door lock device 2.

The above embodiments are only set forth to illustrate the principles of the present disclosure, and should not be interpreted as to limit the present disclosure in any way. The above embodiments can be modified by one of ordinary skill in the art without departing from the scope of the present disclosure as defined in the appended claims.

What is claimed is:

1. A door lock device, comprising:

a lock assembly including a push bar and a lock provided on the push bar;

a base provided within the push bar and including a receiving space;

a connecting rod provided within the push bar and passing through the receiving space to link with the lock, wherein the connecting rod includes an elevated portion;

a sliding piece provided within the receiving space in a displaceable manner;

a swinging piece pivotally connected to the base and positioned in the receiving space to link with the sliding piece;

a driver for driving the sliding piece to displace, wherein the sliding piece is actuated to drive the swinging piece to swing upwards and cross over the elevated portion; and a sensing component provided on the swinging piece and communicatively connected with the driver for sensing movements of the connecting rod, wherein when the push bar is pressed for a first time, the swinging piece does not cross over the elevated portion, such that the connecting rod is prevented from moving by the swinging piece to the lock being locked, and the elevated portion abuts against and actuates the sensing component to send a control signal to a circuit component, wherein after a target period has elapsed, the circuit component sends a response signal to the driver, such that the driver is actuated to move the sliding piece to push the swinging piece, and the swinging piece swings upwards and crosses over the elevated portion, and wherein after the swinging piece swings upwards and crosses over the elevated portion, the push bar is pressed for a second time, the connecting rod is allowed to move, and the pressing of the push bar allows the lock to be unlocked.

2. The door lock device of claim 1, wherein the base is fixed to the push bar via a supporting piece.

3. The door lock device of claim 1, wherein the base is directly fixed to the push bar.

4. The door lock device of claim 1, wherein the sensing component senses a distance between the elevated portion and the sensing component.

5. The door lock device of claim 1, wherein the sensing component is communicatively connected with a driver via a circuit component.

6. An electric control assembly, comprising:

a base including a receiving space;

a connecting rod passing through the receiving space and including an elevated portion;

a sliding piece provided within the receiving space in a displaceable manner;

a swinging piece pivotally connected to the base and positioned in the receiving space to link with the sliding piece, wherein the sliding piece drives the swinging piece to swing upwards and cross over the elevated portion;

a sensing component provided on the swinging piece for sensing a distance between the elevated portion and the sensing component; and a driver communicatively connected with the sensing component for driving the sliding piece to displace, wherein the swinging piece does not cross over the elevated portion initially, such that the connecting rod is prevented from moving by the swinging piece, and the elevated portion abuts against and actuates the sensing component to send a control signal to a circuit component, wherein after a target period has elapsed, the circuit component sends a response signal to the driver, such that the driver is actuated to move the sliding piece to push the swinging piece, and the swinging piece swings upwards and crosses over the elevated portion, and wherein after the swinging piece swings upwards and crosses over the elevated portion, the connecting rod is allowed to move.

7. The electric control assembly of claim 6, wherein the base includes a slot formed corresponding to a direction along which the connecting rod passes through the receiving space.

8. The electric control assembly of claim 6, wherein the base includes a bar frame to allow ease of handling.

* * * * *